US009702303B2

(12) United States Patent
Saito et al.

(10) Patent No.: US 9,702,303 B2
(45) Date of Patent: Jul. 11, 2017

(54) ACCELERATOR APPARATUS FOR VEHICLE

(71) Applicant: DENSO CORPORATION, Kariya, Aichi-pref. (JP)

(72) Inventors: Takehiro Saito, Anjo (JP); Masahiro Makino, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/713,219

(22) Filed: May 15, 2015

(65) Prior Publication Data

US 2015/0247466 A1 Sep. 3, 2015

Related U.S. Application Data

(63) Continuation of application No. 13/721,495, filed on Dec. 20, 2012, now Pat. No. 9,228,502.

(30) Foreign Application Priority Data

Dec. 21, 2011 (JP) ..... 2011-279665

(51) Int. Cl.

| | |
|---|---|
| ***F02D 11/02*** | (2006.01) |
| ***F02D 11/10*** | (2006.01) |
| ***G05G 1/38*** | (2008.04) |
| ***G05G 1/44*** | (2008.04) |
| ***G05G 5/03*** | (2008.04) |

(52) U.S. Cl.

CPC ..... *F02D 11/02* (2013.01); *F02D 11/107* (2013.01); *G05G 1/38* (2013.01); *G05G 1/44* (2013.01); *G05G 5/03* (2013.01); *Y10T 74/20534* (2015.01)

(58) Field of Classification Search

CPC ..... G05G 1/38; G05G 1/44

USPC ..... 74/513, 512, 560

See application file for complete search history.

(56) References Cited

U.S. PATENT DOCUMENTS

| | | | | |
|---|---|---|---|---|
| 7,278,337 | B2 | 10/2007 | Solta | |
| 7,954,589 | B2 * | 6/2011 | Sand | B60R 21/01 180/274 |
| 8,539,858 | B2 * | 9/2013 | Saito | B60K 26/021 74/512 |
| 9,176,517 | B2 * | 11/2015 | Pelletier | G05G 1/38 |
| 9,228,502 | B2 * | 1/2016 | Saito | G05G 1/44 |

(Continued)

FOREIGN PATENT DOCUMENTS

| | | |
|---|---|---|
| JP | 2003-025865 | 1/2003 |
| JP | 2004-168239 | 6/2004 |

(Continued)

OTHER PUBLICATIONS

EPO Machine Translation of JP2007253869, Saito et al., Oct. 2007.*

(Continued)

*Primary Examiner* — Vinh Luong
(74) *Attorney, Agent, or Firm* — Nixon & Vanderhye P.C.

(57) ABSTRACT

At a supporting member, an angle between an imaginary extension plane of an outer surface of a first partition wall and an imaginary extension plane of an upper surface of a pedal arm is one of an obtuse angle and a right angle. An angle between an imaginary extension plane of an outer surface of a third partition wall and an imaginary extension plane of a lower surface of the pedal arm is one of an obtuse angle and a right angle.

4 Claims, 8 Drawing Sheets

(56) References Cited

U.S. PATENT DOCUMENTS

| | | | | |
|---|---|---|---|---|
| 9,465,403 | B2 * | 10/2016 | Kihara | G05G 1/38 |
| 2001/0007206 | A1 * | 7/2001 | Kato | B60K 26/02 73/114.01 |
| 2004/0149070 | A1 * | 8/2004 | Solta | B60K 26/02 74/513 |
| 2006/0169549 | A1 * | 8/2006 | Lang | B60T 7/045 188/73.1 |
| 2008/0149411 | A1 * | 6/2008 | Schlabach | G05G 1/38 180/315 |
| 2008/0276749 | A1 * | 11/2008 | Stewart | G05G 1/38 74/512 |
| 2010/0199800 | A1 * | 8/2010 | Horie | F16F 1/128 74/513 |
| 2010/0206122 | A1 * | 8/2010 | Seiltz | G05G 1/38 74/512 |
| 2011/0113874 | A1 * | 5/2011 | Park | B60T 7/042 73/121 |
| 2012/0006145 | A1 * | 1/2012 | Hotta | G05G 1/38 74/513 |
| 2012/0060642 | A1 | 3/2012 | Yamaguchi et al. | |
| 2013/0160600 | A1 | 6/2013 | Saito | |
| 2013/0186228 | A1 | 7/2013 | Saito et al. | |
| 2014/0251068 | A1 | 9/2014 | Ooya et al. | |

FOREIGN PATENT DOCUMENTS

| | | | | |
|---|---|---|---|---|
| JP | 2007-253869 | | 10/2007 | |
| JP | 2010-211581 | * | 9/2010 | G05G 1/38 |

OTHER PUBLICATIONS

Office Action issued in corresponding Japanese Patent Application No. 2011-279665, dated Oct. 17, 2013 (with translation).

* cited by examiner

ACCELERATOR APPARATUS FOR VEHICLE

CROSS REFERENCE TO RELATED APPLICATION

This application is a continuation of U.S. patent application Ser. No. 13/721,495, filed on Dec. 20, 2012, which claims priority to Japanese Patent Application No. 2011-279665 filed on Dec. 21, 2011, the entire contents of each of which are hereby incorporated by reference.

TECHNICAL FIELD

The present disclosure relates to an accelerator apparatus for a vehicle.

BACKGROUND

A known accelerator apparatus controls an acceleration state of a vehicle according to the amount of depression of an accelerator pedal, which is depressed by a foot of a driver of the vehicle. In the accelerator apparatus, a rotational angle of a shaft, which corresponds to a rotational angle of a pedal arm connected to the pedal, is sensed. In the vehicle, an opening degree of a throttle valve, which adjusts a quantity of intake air drawn into cylinders of an internal combustion engine of the vehicle, is determined based on the sensed rotational angle. JP2007-253869A discloses an accelerator pedal apparatus that includes a spring (an urging means) and a hysteresis mechanism accommodated in a supporting member that rotatably supports the shaft. The spring urges the shaft in an accelerator closing direction to rotate the shaft in the accelerator closing direction. The hysteresis mechanism makes a pedal force, which is applied to the accelerator pedal at the time of depressing the accelerator pedal, to be larger than a pedal force, which is applied to the accelerator pedal at the time of releasing the depressed accelerator pedal.

However, in the accelerator apparatus of JP2007-253869A, the supporting member has an opening, which corresponds to a movable range of the pedal arm. A foreign object (e.g., a small pebble, particulate debris) may possibly enter an interior of the supporting member through this opening. When the foreign object enters the interior of the supporting member, the accelerator apparatus may not function properly.

SUMMARY

The present disclosure is made in view of the above disadvantage. According to the present disclosure, there is provided an accelerator apparatus for a vehicle. The accelerator apparatus includes a supporting member, a shaft, a rotatable body, a pedal arm, a rotational angle sensing device and an urging device. The supporting member is installable to a body of the vehicle. The shaft is received in an interior of the supporting member and is rotatably supported by the supporting member. The rotatable body is received in the interior of the supporting member and is fixed to an outer wall of the shaft. The rotatable body is rotatable integrally with the shaft in an accelerator opening direction and is also rotatable integrally with the shaft in an accelerator closing direction, which is opposite from the accelerator opening direction. The pedal arm has one end portion, which is fixed to the rotatable body. The other end portion of the pedal arm, which is opposite from the one end portion of the pedal arm, has a depressible portion that is depressible by a driver of the vehicle. The rotational angle sensing device is received in the interior of the supporting member and senses a rotational angle of the shaft relative to the supporting member. The urging device is received in the interior of the supporting member and urges the shaft in the accelerator closing direction to rotate the shaft in the accelerator closing direction. The supporting member has an opening. The pedal arm extends from the rotatable body, which is located on an inner side of the opening, to the depressible portion, which is located on an outer side of the opening, through the opening. An outer wall of the rotatable body, which is located adjacent to the opening, forms a protruding curved surface, which protrudes in a projecting direction of the pedal arm from the rotatable body, in a movable range of the pedal arm. An angle between a first imaginary extension plane of a first outer surface of a first outer wall, which is formed in an outer wall of the supporting member, and a second imaginary extension plane of a second outer wall, which is formed in the pedal arm, is one of an obtuse angle and a right angle. The first outer wall defines the opening and is located on an accelerator closing side of the opening in the accelerator closing direction. The second outer wall is located on an accelerator closing side of the pedal arm in the accelerator closing direction. An angle between a third imaginary extension plane of a third outer surface of a third outer wall, which is formed in the outer wall of the supporting member, and a fourth imaginary extension plane of a fourth outer wall, which is formed in the pedal arm, is one of an obtuse angle and a right angle. The third outer wall defines the opening and is located on an accelerator opening side of the opening in the accelerator opening direction. The fourth outer wall is located on an accelerator opening side of the pedal arm in the accelerator opening direction.

BRIEF DESCRIPTION OF THE DRAWINGS

The drawings described herein are for illustration purposes only and are not intended to limit the scope of the present disclosure in any way.

DETAILED DESCRIPTION

Various embodiments of the present disclosure will be described with reference to the accompanying drawings.

(First Embodiment)

FIGS. 1 to 7B show an accelerator apparatus 1 according to a first embodiment of the present disclosure.

The accelerator apparatus 1 is an input apparatus, which is manipulated by a driver of a vehicle (automobile) to determine a valve opening degree of a throttle valve of an internal combustion engine of the vehicle (not shown), which adjusts a quantity (an intake air quantity) of air that is drawn into cylinders of the internal combustion engine. The accelerator apparatus 1 is an electronic type accelerator apparatus that is electronically controlled. The accelerator apparatus 1 transmits information, which relates to the amount of depression of an accelerator pedal 20, to an electronic control device (not shown). The electronic control device drives a throttle valve through a throttle actuator (not shown) based on the information of the amount of depression of the accelerator pedal 20 and/or the other information.

Figure 1:
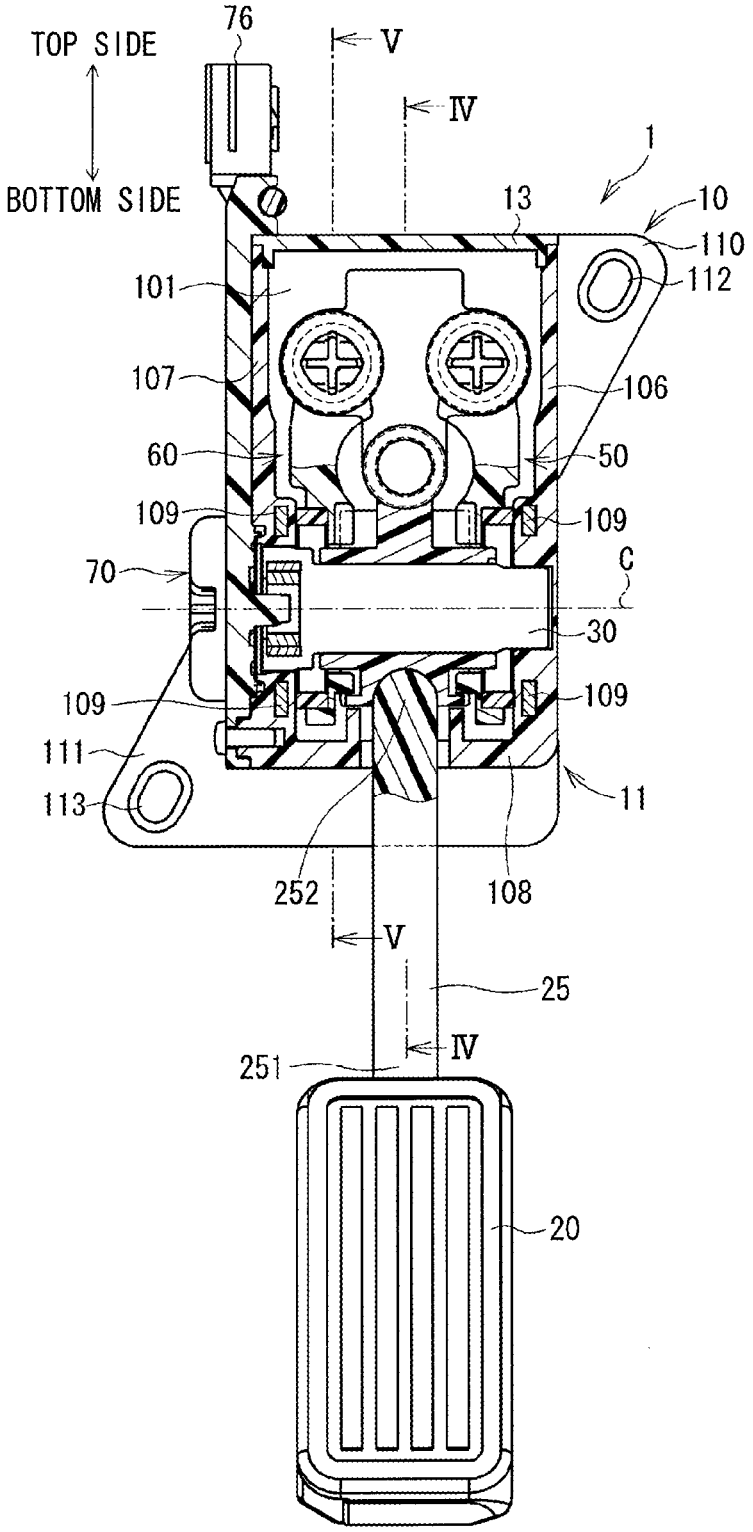
FIG. 1 is a front cross-sectional view of an accelerator apparatus according to a first embodiment of the present disclosure.

With reference to FIG. 1, the accelerator apparatus 1 includes a supporting member 10, the accelerator pedal 20, a pedal arm 25, a shaft 30, a return spring 45 (see FIG. 4), a first hysteresis mechanism 50, a second hysteresis mechanism 60 and a rotational angle sensing device 70. For descriptive purpose, an upper side of FIGS. 1 to 5 will be referred to as a top side of the accelerator apparatus 1, and a lower side of FIGS. 1 to 5 will be referred to as a bottom side of the accelerator apparatus 1. Furthermore, a right side of FIGS. 1 and 2 will be referred to as a right side of the accelerator apparatus 1, and a left side of FIGS. 1 and 2 will be referred to as a left side of the accelerator apparatus 1.

Figure 3:
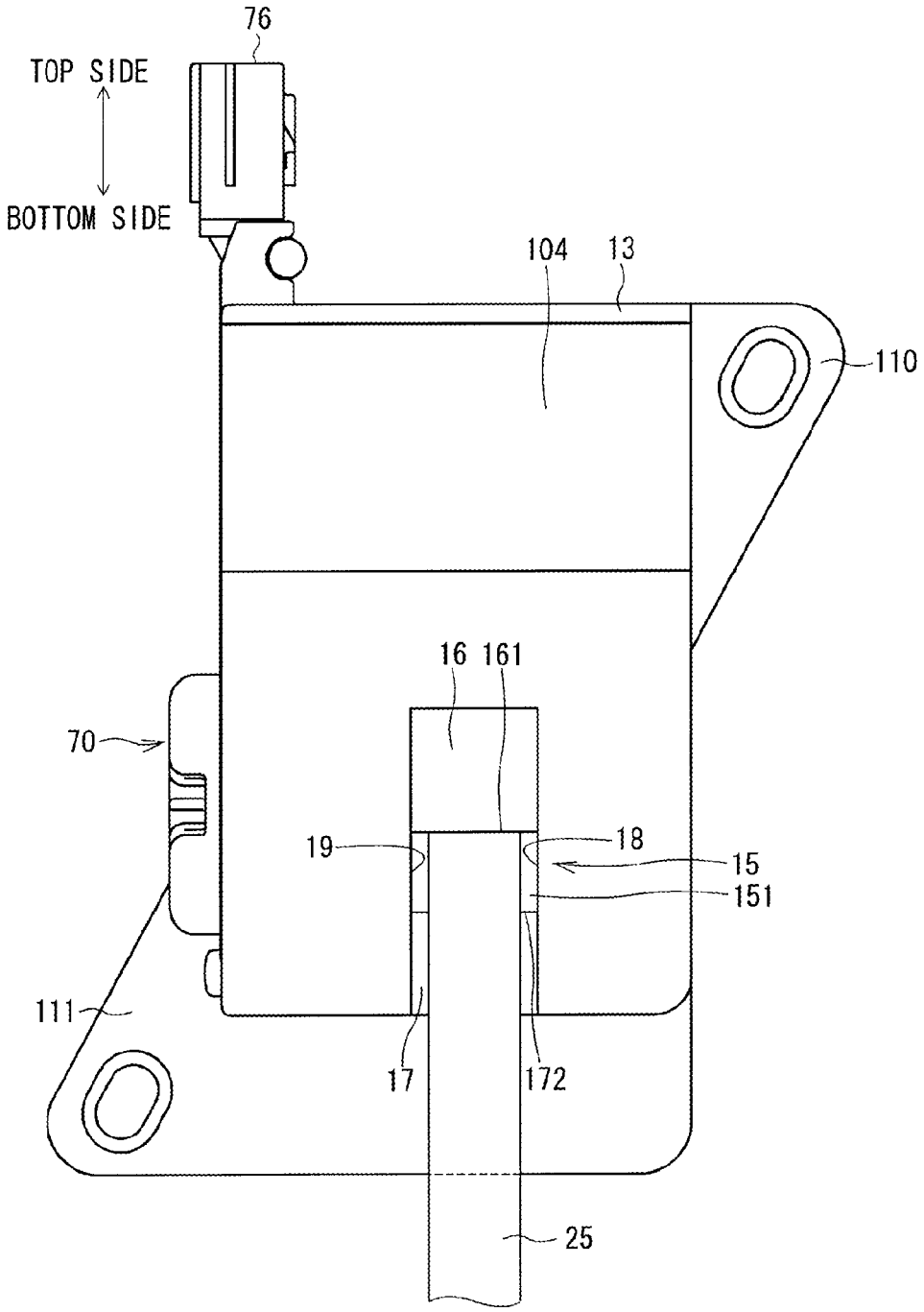
FIG. 3 is a front view of the accelerator apparatus shown in FIG. 1.

The supporting member 10 includes a housing 11, which is configured into a hollow box form, and a cover 13 (see FIG. 3).

The housing 11 includes an installing segment 105, a front side segment 104, an opening segment 15, a first shaft supporting segment 106, a second shaft supporting segment 107 and a bottom segment 108. The front side segment 104 is opposed to the installing segment 105 in a direction perpendicular to a plane of the installing segment 105. The opening segment 15 is formed in the front side segment 104 at a bottom side part (a lower side part in FIG. 3) of the front side segment 104. The first shaft supporting segment 106 and the second shaft supporting segment 107 are located on the right side and the left side, respectively, of the front side segment 104 and the installing segment 105 and connect between the front side segment 104 and the installing segment 105. The bottom side segment 108 is located on the bottom side of the front side segment 104 and the installing segment 105 and connects the front side segment 104 and the opening segment 15 to the installing segment 105.

The housing 11 is a resin molded article (a resin molded product) that is configured such that a reinforcing member 109, which is made of metal, is embedded in the installing segment 105, the first shaft supporting segment 106 and the second shaft supporting segment 107, which are made of a resin material. The supporting member 10 is formed by, for example, insert molding. The reinforcing member 109 is configured into a U-shaped body that has an opening that opens in the top-to-bottom direction on the front side of the accelerator apparatus 1.

Figure 2:
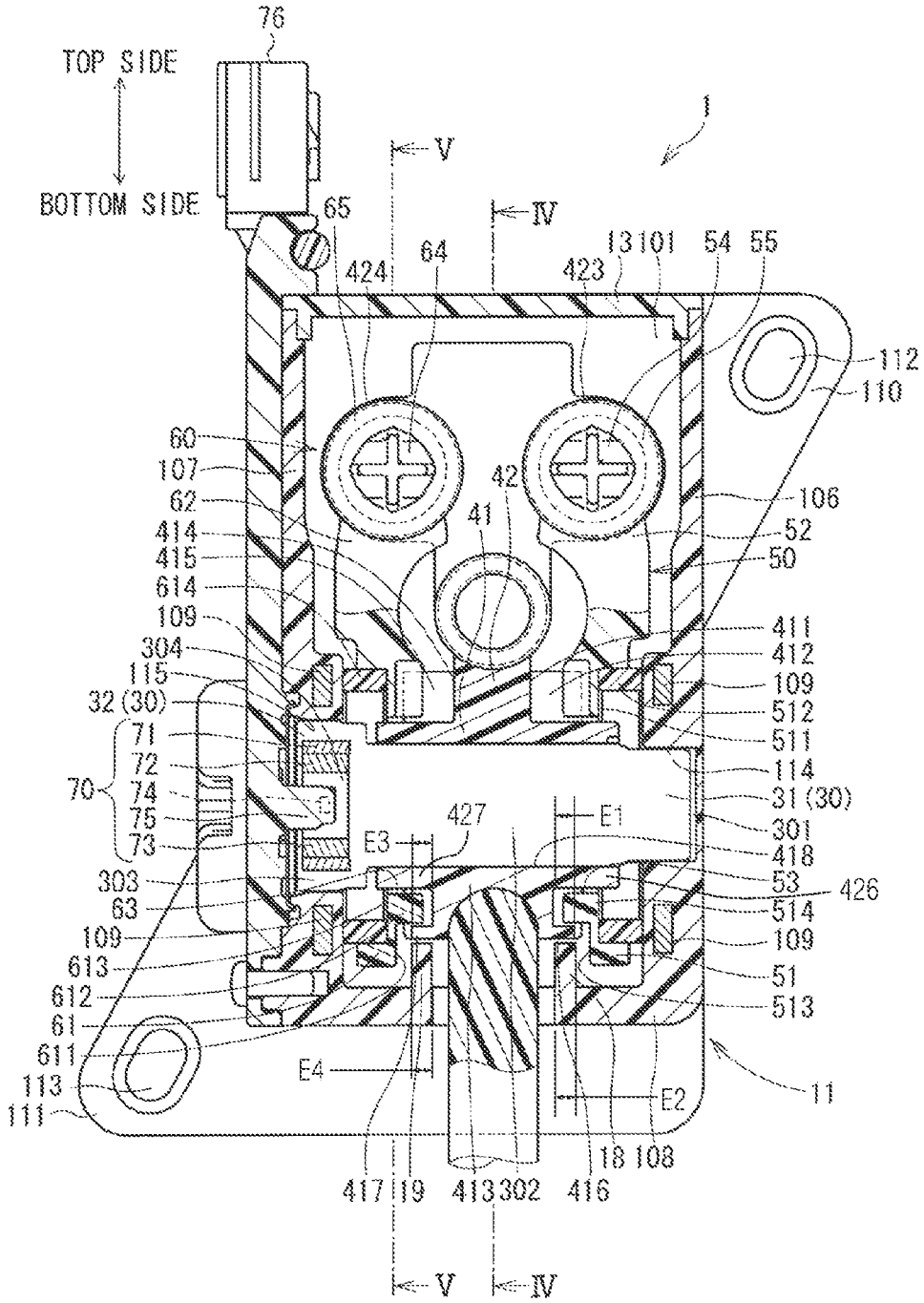
FIG. 2 is a partial enlarged cross-sectional view, showing a portion of the accelerator apparatus shown in FIG. 1.

The installing segment 105 is configured into the planar body and is installable to, for example, a wall of a passenger compartment of the vehicle, which forms a part of the passenger compartment. As shown in FIGS. 1 and 2, the installing segment 105 includes a right side base 110 and a left side base 111, which are formed at the right side and the left side, respectively, of the installing segment 105. A bolt hole 112 and a bolt hole 113 are formed in the right side base 110 and the left side base 111, respectively, such that a corresponding bolt (not shown) is inserted through each of the bolt hole 112 and the bolt hole 113 to install the accelerator apparatus 1 to the body of the vehicle.

An opening 151 is formed in the opening segment 15 such that the pedal arm 25, which is connected, i.e., is fixed to a pedal rotor (serving as a rotatable body) 41, projects outward through the opening 151. The opening 151 opens obliquely downward toward the bottom side of the accelerator apparatus 1. The details of the configuration of the opening segment 15 will be described later.

Referring back to FIG. 2, the first shaft supporting segment 106 and the second shaft supporting segment 107 are generally parallel to each other. The first shaft supporting segment 106 rotatably supports one end portion 31 of the shaft 30, which will be described later in detail. The first shaft supporting segment 106 functions as a receiving portion, which receives an urging force of a first friction plate 512. The second shaft supporting segment 107 rotatably supports the other end portion 32 of the shaft 30, which is opposite from the one end portion 31. The second shaft supporting segment 107 functions as a receiving portion, which receives an urging force of a second friction plate 614.

The cover 13 is provided on the upper side of the housing 11 and is connected to the front side segment 104, the first shaft supporting segment 106, the second shaft supporting segment 107 and the installing segment 105 to form a housing interior space 101, which forms a closed space and serves as an interior of the supporting member 10.

The pedal 20, which serves as a depressible portion, is provided to the other end portion 251 of the pedal arm 25, which is opposite from the pedal rotor 41. The one end portion 252 of the pedal arm 25 is fixed to a connecting portion 413 of the pedal rotor 41, as shown in FIG. 1.

Figure 4:
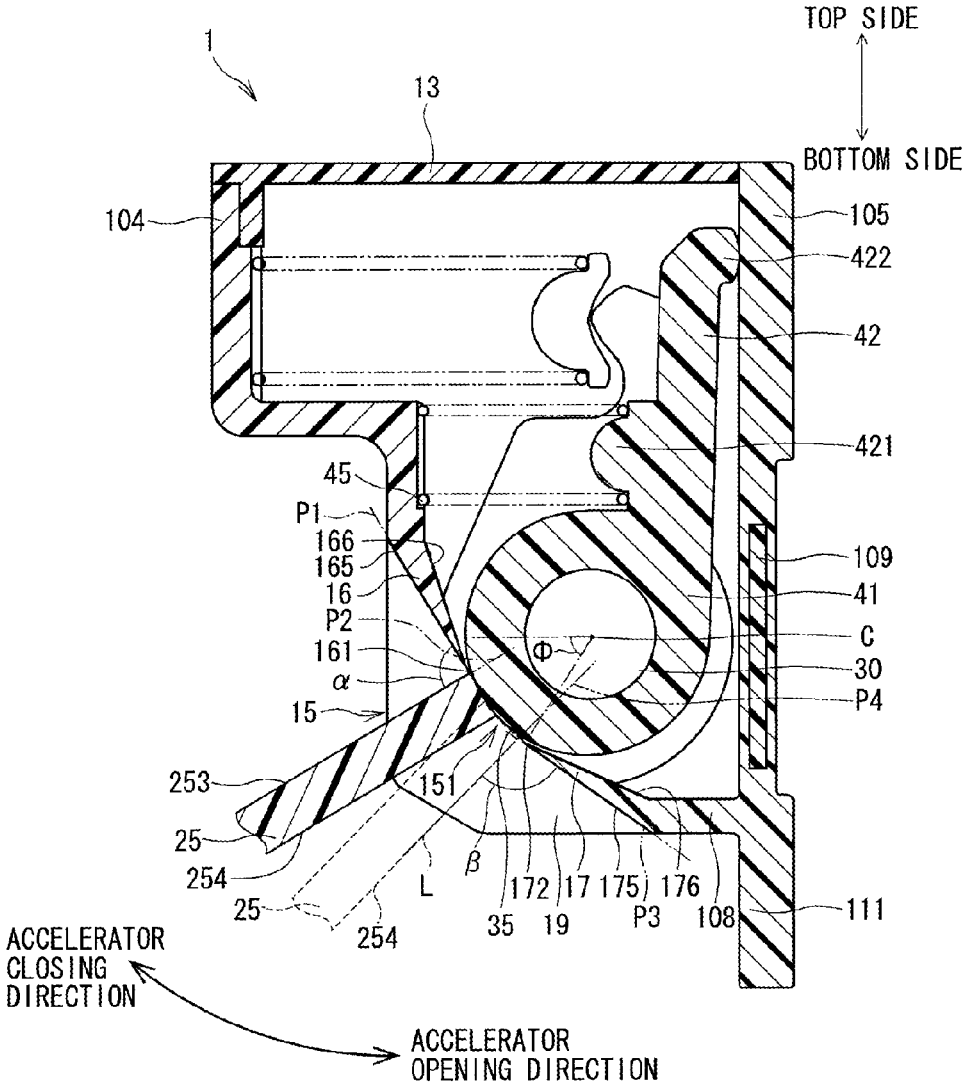
FIG. 4 is a cross-sectional view taken along line IV-IV in FIG. 1.

When a pedal force of the driver, which is applied from a foot of the driver to the pedal 20, is increased, the pedal arm 25 is rotated in a counter-clockwise direction about a center axis C of the shaft 30 in FIG. 4. This counter-clockwise direction of the pedal arm 25 about the center axis C will be referred to as an accelerator opening direction, and the clockwise direction of the pedal arm 25 about the center axis C will be referred to as an accelerator closing direction.

The shaft 30 extends in a horizontal direction at the bottom side of the accelerator apparatus 1. The shaft 30 includes a large diameter portion 303, an intermediate diameter portion 302 and a small diameter portion 301, which are arranged in this order from the side where the rotational angle sensing device 70 is located.

The small diameter portion 301 is formed to have an outer diameter that is smaller than an outer diameter of the large diameter portion 303 and an outer diameter of the intermediate diameter portion 302. The small diameter portion 301 is fitted into a fitting hole 114, which is formed in an inner wall of the first shaft supporting segment 106.

The outer diameter of the intermediate diameter portion 302 is smaller than the outer diameter of the large diameter portion 303 and is larger than the outer diameter of the small diameter portion 301. The intermediate diameter portion 302 is fixed to a through-hole 418, which is formed in the pedal rotor 41, by, for example, press-fitting of the intermediate diameter portion 302 into the through-hole 418. The through-hole 418 extends through cylindrical tubular projections (serving as first and second primary projections) 426, 427 of the pedal rotor 41. The cylindrical tubular projection 426, 427 projection in an axial direction of a rotational axis of the pedal rotor 41 and are located on one axial side and the other axial side, respectively, of the pedal rotor 41. Thus, the pedal rotor 41 is fixed to an outer wall of the intermediate diameter portion 302 of the shaft 30, and thereby the pedal rotor 41 is rotatable integrally with the shaft 30 in both of the accelerator opening direction and the accelerator closing direction.

The large diameter portion 303 is fitted into a fitting hole 115 of the second shaft supporting segment 107. The large diameter portion 303 includes a recess 304 in an end surface of the large diameter portion 303, which is opposite from the intermediate diameter portion 302. The recess 304 receives a yoke 71 and magnets 72, 73 of the rotational angle sensing device 70.

The pedal rotor 41 is configured into a cylindrical form and is placed radially outward of the shaft 30. An arm portion 42 is connected to an upper side of the pedal rotor 41. The connecting portion 413, to which the one end portion 252 of the pedal arm 25 is connected, is formed in a lower side of the pedal rotor 41. Two projections 416, 417 (serving as first and second secondary projections) are formed at two sides (left and right sides), respectively, of the connecting portion 413 at a radial location that is on a radially outer side of the projections 426, 427. The amount of projection of each of the projections 426, 427, which is measured in the axial direction of the rotational axis, is larger than the amount of projection of each of the projections 416, 417, which is measured in the axial direction of the rotational axis. The projections 416, 417 are formed to overlap with a second partition wall 18 and a fourth partition wall 19 of the housing 11. The axial extents that the projections 416, 417 axially overlap with the second partition wall 18 and the fourth partition wall 19 are labeled E1, E2, E3, and E4 in Fig. 2.

As shown in FIG. 2, first-bevel-gear teeth 412 are formed in a right side surface 411 of the pedal rotor 41. Each of the first-bevel-gear teeth 412 includes a sloped surface, which progressively approaches the first-hysteresis-portion rotor 51 along an extent of the sloped surface in the accelerator-closing direction. In other words, the sloped surface of each of the first-bevel-gear teeth 412 approaches the right side in FIG. 2 along the extent of the sloped surface in the accelerator-closing direction. The first-bevel-gear teeth 412 are arranged one after another at generally equal intervals in the circumferential direction.

As shown in FIG. 2, second-bevel-gear teeth 415 are formed in a left side surface 411 of the pedal rotor 41. Each of the second-bevel-gear teeth 415 includes a sloped surface, which progressively approaches the second-hysteresis-portion rotor 61 along an extent of the sloped surface in the accelerator-closing direction. In other words, the sloped surface of each of the second-bevel-gear teeth 415 approaches the left side in FIG. 2 along the extent of the sloped surface in the accelerator-closing direction. The second-bevel-gear teeth 415 are arranged one after another at generally equal intervals in the circumferential direction.

The arm portion 42 includes a return-spring supporting part 421, a limiting part 422, a first-hysteresis-portion spring receiving part 423 and a second-hysteresis-portion spring receiving part 424.

The return-spring supporting part 421 is formed in a pedal rotor 41 side of the arm portion 42 and projects from the arm portion 42 toward the front side segment 104. One end of the return spring 45 is engaged with the return-spring supporting part 421.

The other end of the return spring 45 is engaged with an inner wall of the front side segment 104. The return spring 45 serves as an urging device (or an urging means) and urges the pedal rotor 41 in the accelerator closing direction to rotate the pedal rotor 41 in the accelerator closing direction in FIG. 4.

The limiting part 422 is formed in an end part of the arm portion 42, which is not connected to the pedal rotor 41, i.e., which is opposite from the pedal rotor 41. The limiting part 422 projects toward the installing segment 105. The limiting part 422 contacts an inner wall of the installing segment 105 when the pedal rotor 41 is rotated in the accelerator closing direction.

The first-hysteresis-portion spring receiving part 423 is a generally rectangular planar part (a generally rectangular plate part), which extends from the limiting part 422 toward the first shaft supporting segment 106. The first-hysteresis-portion spring receiving part 423 is formed between an arm portion 52 of the first hysteresis mechanism 50 and the installing segment 105 in a manner similar to the second-hysteresis-portion spring receiving part 424 discussed below with reference to FIG. 5.

Figure 5:
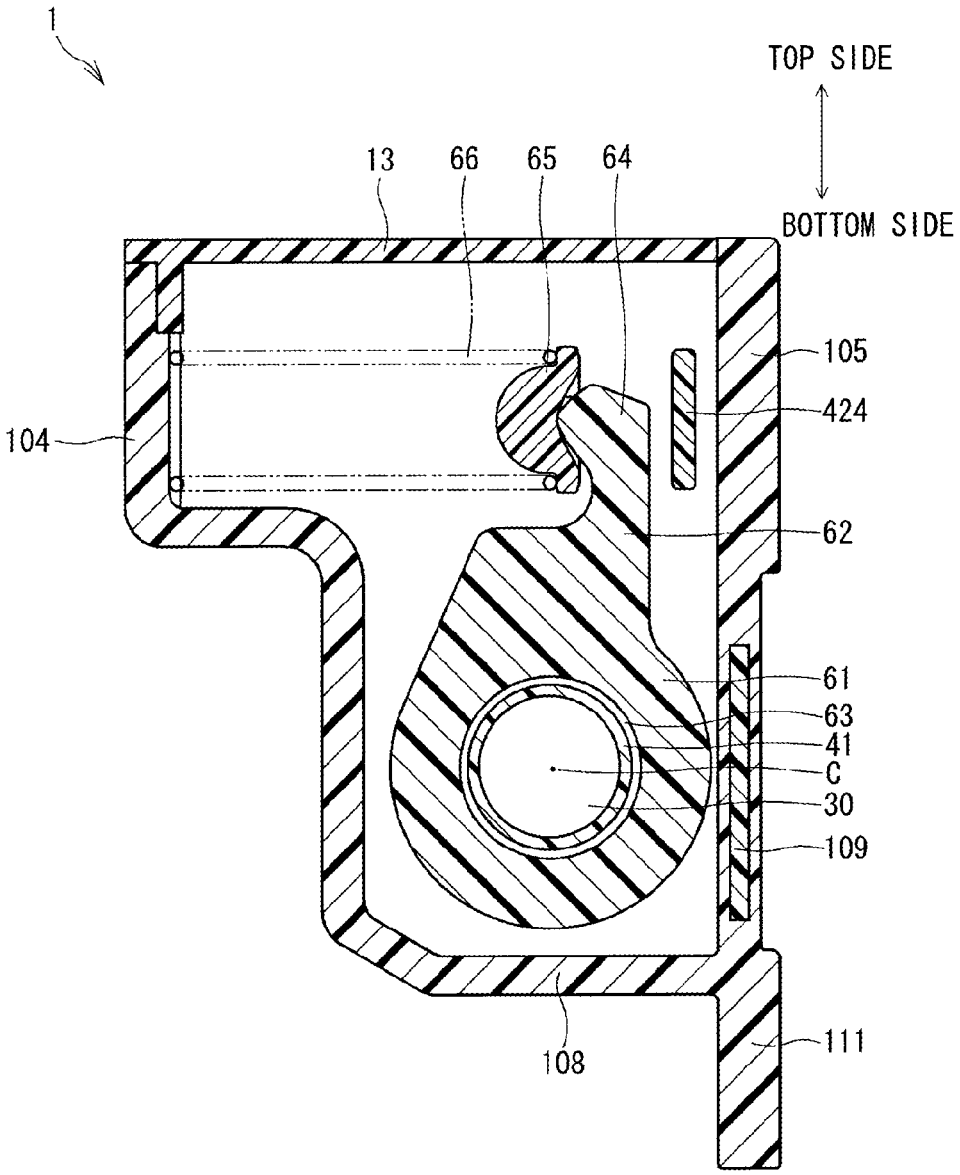
FIG. 5 is a cross-sectional view taken along line V-V in FIG. 1.

The second-hysteresis-portion spring receiving part 424 is a generally rectangular planar part (a generally rectangular plate part), which extends from the limiting part 422 toward the first shaft supporting segment 106. As shown in FIG. 5, the second-hysteresis-portion spring receiving part 424 is formed between an arm portion 62 of the second hysteresis mechanism 60 and the installing segment 105.

The first hysteresis mechanism 50 includes the first-hysteresis-portion rotor 51, the arm portion 52 and a first-hysteresis-portion spring (not shown). Although the first-hysteresis-portion spring is not depicted in the drawings, the first-hysteresis-portion spring is similar to a second-hysteresis-portion spring 66 of the second hysteresis mechanism 60, which will be described later. The arm portion 52 is connected to the first-hysteresis-portion rotor 51. A through-hole 53 is formed to extend through a center part of the first-hysteresis-portion rotor 51 along the center axis C. The pedal rotor 41 is received in the through-hole 53. At this time, the first-hysteresis-portion rotor 51 is not fixed to the pedal rotor 41.

A first friction plate 512 is configured into an annular form (a ring form) and is provided to a right side surface 511 of the first-hysteresis-portion rotor 51. The first friction plate 512 slides along the inner wall of the first shaft supporting segment 106 when the first-hysteresis-portion rotor 51 is rotated. Bevel teeth 514 are formed in a left side surface 513 of the first-hysteresis-portion rotor 51. Each of the bevel teeth 514 includes a sloped surface, which progressively approaches the pedal rotor 41 along an extent of the sloped surface in the accelerator-opening direction. The sloped surface of each of the bevel gear teeth 514 contacts a corresponding one of the sloped surfaces of the first-bevel-gear teeth 412 of the pedal rotor 41.

The arm portion 52 is formed in the first-hysteresis-portion rotor 51 to extend in the top direction, i.e., toward the top side. A first-hysteresis-portion spring engaging part 54 is formed in an upper end part of the arm portion 52. A first-hysteresis-portion spring holder 55 is engaged with the first-hysteresis-portion spring engaging part 54. Furthermore, one end of the first-hysteresis-portion spring (not shown) is engaged with the first-hysteresis-portion spring holder 55 in a manner similar to that of the second-hysteresis-portion spring 66 relative to the second-hysteresis-portion spring holder 65 shown in FIG. 5. The other end of the first-hysteresis-portion spring is engaged with the inner wall of the front side segment 104 in a manner similar to that of the second-hysteresis-portion spring 66 shown in FIG. 5. The first-hysteresis-portion spring urges the first-hysteresis-portion rotor 51 in the accelerator closing direction to rotate the first-hysteresis-portion rotor 51 in the accelerator closing direction.

The second hysteresis mechanism 60 includes the second-hysteresis-portion rotor 61, the arm portion 62 and the second-hysteresis-portion spring 66. The arm portion 62 is connected to the second-hysteresis-portion rotor 61. A through-hole 63 is formed to extend through a center part of the second-hysteresis-portion rotor 61 along the center axis C. The pedal rotor 41 is received in the through-hole 63. The second-hysteresis-portion rotor 61 is not fixed to the pedal rotor 41.

Bevel teeth 612 are formed in a right side surface 611 of the second-hysteresis-portion rotor 61. Each of the bevel teeth 612 includes a sloped surface, which progressively approaches the pedal rotor 41 along an extent of the sloped surface in the accelerator-opening direction. The sloped surface of each of the bevel gear teeth 514 contacts a corresponding one of the sloped surfaces of the second-bevel-gear teeth 415 of the pedal rotor 41. A second friction plate 614 is configured into an annular form (a ring form) and is provided to a left side surface 613 of the second-hysteresis-portion rotor 61. The second friction plate 614 slides along the inner wall of the second shaft supporting segment 107 when the second-hysteresis-portion rotor 61 is rotated.

The arm portion 62 is formed in the second-hysteresis-portion rotor 61 to extend in the top direction, i.e., toward the top side. A second-hysteresis-portion spring engaging part 64 is formed in an upper end part (the top side) of the arm portion 62. A second-hysteresis-portion spring holder 65 is engaged with the second-hysteresis-portion spring engaging part 64. Furthermore, one end of the second-hysteresis-portion spring 66 is engaged with the second-hysteresis-portion spring holder 65. The other end of the second-hysteresis-portion spring 66 is engaged with the inner wall of the front side segment 104. The second-hysteresis-portion spring 66 urges the second-hysteresis-portion rotor 61 in the accelerator closing direction to rotate the second-hysteresis-portion rotor 61 in the accelerator closing direction.

The rotational angle sensing device 70, which also serves as a rotational angle sensing means, includes the yoke 71, the magnets 72, 73 and a Hall element 74.

The yoke 71 is made of a magnetic material and is configured into a tubular form. The yoke 71 is fixed to an inner peripheral wall of the recess 304 of the large diameter portion 303. The magnets 72, 73 are fixed to an inner peripheral wall of the yoke 71 such that the magnets 72, 73 are diametrically opposed to each other about the center axis C of the shaft 30 at a location that is radially inward of the yoke 71, and radially inner side magnetic poles of the magnets 72, 73, which are diametrically opposed to each other, are different from each other. The Hall element 74 is placed between the magnet 72 and the magnet 73 and is received in a projecting part 75, which projects from the second shaft supporting segment 107 in the direction of the center axis C of the shaft 30.

When a magnetic field is applied to the Hall element 74, through which an electric current flows, a voltage is generated in the Hall element 74. This phenomenon is referred to as a Hall effect. A density of a magnetic flux, which penetrates through the Hall element 74, changes when the shaft 30 and the magnets 72, 73 are rotated about the center axis C of the shaft 30. A value of the voltage discussed above is substantially proportional to the density of the magnetic flux, which penetrates through the Hall element 74. The rotational angle sensing device 70 senses the voltage generated in the Hall element 74 and thereby senses a relative rotational angle between the Hall element 74 and the magnets 72, 73, i.e., a relative rotational angle of the shaft 30 relative to the supporting member 10. The rotational angle sensing device 70 outputs an electric signal, which indicates the sensed voltage, to the electronic control device through a terminal 76.

Next, with reference to FIGS. 3 and 4, there will be described the configuration of the housing 11, particularly, the configuration of the opening segment 15 that forms the opening 151, from which the pedal arm 25 projects outwardly. FIG. 4 shows the relationship between the pedal arm 25 (indicated by a solid line) and the opening segment 15 at the accelerator-full-closing time of the accelerator apparatus 1 (i.e., the time of placing the pedal arm 25 in the accelerator-full-closing position indicated with the solid line shown in FIG. 4). Furthermore, the position (the accelerator-full-opening position) of the pedal arm 25 in the accelerator-full-opening time is indicated by a dotted line L in FIG. 4.

As shown in FIG. 3, the opening segment 15 is formed in the center part (the left-to-right center part in FIG. 3) of the bottom side of the front side segment 104. The opening segment 15 includes a first partition wall 16, a third partition wall 17, the second partition wall 18 and the fourth partition wall 19. The opening 151, which is configured into a generally rectangular form elongated in the left-to-right direction in FIG. 3, is formed in the center part of the opening segment 15.

The opening 151 is formed by, i.e., is defined by a lower end 161 of the first partition wall 16, an upper end 172 of the third partition wall 17, the second partition wall 18 and the fourth partition wall 19. A size of the opening 151 corresponds to a movable range of the pedal arm 25. Specifically, the lower end 161 of the first partition wall 16, the upper end 172 of the third partition wall 17, the second partition wall 18 and the fourth partition wall 19 are formed such that the lower end 161 of the first partition wall 16, the upper end 172 of the third partition wall 17, the second partition wall 18 and the fourth partition wall 19 do not limit the movable range (movement) of the pedal arm 25 at the accelerator-full-closing time or the accelerator-full-opening time. A width of the opening 151, which is measured in a direction (the top-to-bottom direction in FIG. 3) perpendicular to the center axis C of the shaft 30, is generally constant along the center axis C of the shaft 30.

Here, an exposed surface of an outer wall of the pedal rotor 41, which is exposed to the outside of the housing 11 through the opening 151 in conformity with the movable range of the pedal arm 25, will be referred to as an exposed surface 35. As shown in FIG. 4, the exposed surface 35 is formed in the outer wall of the pedal rotor 41 to arcuately extend through a predetermined angle Φ about a point located along the center axis C. In the first embodiment, a shape of the cross section of the exposed surface 35, which is taken in a direction perpendicular to the center axis C, is an arcuate shape that is centered at the point located along the center axis C. In other words, the exposed surface 35 of the pedal rotor 41, which is located adjacent to the opening 151, serves as a protruding curved surface, which protrudes in a projecting direction of the pedal arm 25 from the pedal rotor 41, in the movable range of the pedal arm 25. In other words, the protruding curved surface, i.e., the exposed surface 35 of the pedal rotor 41 is formed in the predetermined circumferential range of the outer wall of the pedal rotor 41, which extends by the predetermined angle Φ and covers the movable range of the pedal arm 25 between the accelerator-full-closing position and the accelerator-full-opening position of the pedal arm 25 shown in FIG. 4. The exposed surface 35 may also be referred to as an outer wall (or an outer wall surface) of the rotatable body (the pedal rotor 41), which is adjacent to the opening 151.

The first partition wall 16 is formed to extend generally parallel to the center axis C. An outer surface (serving as a first outer surface) 165 of the first partition wall 16 is tilted such that the outer surface 165 progressively approaches the installing segment 105 from the top side of the outer surface 165 toward the bottom side of the outer surface 165 in FIG. 4. In other words, the distance between the outer surface 165 and the installing segment 105, which is measured in the direction (the left-to-right direction in FIG. 4) that is perpendicular to the plane of the installing segment 105, progressively decreases toward the opening 151 in the direction that is parallel to the plane of the installing segment 105. A distance between the outer surface 165 of the first partition wall 16 and an inner surface (serving as a first inner surface) 166 of the first partition wall 16 progressively decreases toward the opening 151. The outer surface 165 and the inner surface 166 are connected with each other at the lower end 161 of the first partition wall 16, which defines the opening 151, i.e., which determines a corresponding boundary of the opening 151. An upper end of the first partition wall 16 is connected to the front side segment 104. Two lateral ends of the first partition wall 16 are connected to the second partition wall 18 and the fourth partition wall 19, respectively. The first partition wall 16 may serve as a first outer wall.

In the accelerator-full-closing time shown in FIG. 4, in which the pedal arm 25 is placed in the accelerator-full-closing position indicated by the solid line to fully close the throttle valve, an angle, which is formed between an imaginary extension plane (imaginary extension surface) P1 of the outer surface 165 of the first partition wall 16 and an imaginary extension plane (imaginary extension surface) P2 of an upper surface 253 of the pedal arm 25, is defined as an angle α. Here, the upper surface 253 of the pedal arm 25 is located on the accelerator closing side of the pedal arm 25 in the accelerator closing direction. The upper surface 253 of the pedal arm 25 may serve as a second outer wall. The imaginary extension plane P1 is formed by extending the outer surface 165 of the first partition wall 16 and may serve as a first imaginary extension plane. The imaginary extension plane P2 is formed by extending the upper surface 253 of the pedal arm 25 and may serve as a second imaginary extension plane. The outer surface 165 of the first partition wall 16 is configured and is placed to set the angle α to an obtuse angle in this embodiment.

The third partition wall 17 is formed to extend generally parallel to the center axis C of the shaft 30. An outer surface (serving as a third outer surface) 175 of the third partition wall 17 is tilted such that the outer surface 175 is progressively displaced away from the installing segment 105 from the bottom side of the outer surface 175 toward the top side of the outer surface 175 in FIG. 4. In other words, the distance between the outer surface 175 and the installing segment 105, which is measured in the direction (the left-to-right direction in FIG. 4) that is perpendicular to the plane of the installing segment 105, progressively increases toward the opening 151 in the direction that is parallel to the plane of the installing segment 105. A distance between the outer surface 175 of the third partition wall 17 and an inner surface (serving as a third inner surface) 176 of the third partition wall 17 progressively decreases toward the opening 151. The outer surface 175 and the inner surface 176 are connected with each other at the upper end 172 of the third partition wall 17, which defines the opening 151, i.e., which determines a corresponding boundary of the opening 151. A lower end of the third partition wall 17 is connected to the bottom segment 108. Two lateral ends of the third partition wall 17 are connected to the second partition wall 18 and the fourth partition wall 19, respectively. The third partition wall 17 may serve as a third outer wall.

In the accelerator-full-opening time, in which the pedal arm 25 is placed in the full opening position indicated with the dotted line L in FIG. 4 to fully open the throttle valve, an angle, which is formed between an imaginary extension plane (imaginary extension surface) P3 of the outer surface 175 of the third partition wall 17 and an imaginary extension plane (imaginary extension surface) P4 of a lower surface 254 of the pedal arm 25, is defined as an angle β. Here, the lower surface 254 of the pedal arm 25 is located on the accelerator opening side of the pedal arm 25 in the accelerator opening direction. The lower surface 254 of the pedal arm 25 may serve as a fourth outer wall. The imaginary extension plane P3 is formed by extending the outer surface 175 of the third partition wall 17 and may serve as a third imaginary extension plane. The imaginary extension plane P4 is formed by extending the lower surface 254 of the pedal arm 25 and may serve as a fourth imaginary extension plane. The outer surface 175 of the third partition wall 17 is configured and is placed to set the angle β to an obtuse angle in this embodiment.

The second partition wall 18 is configured into a generally triangular form and extends in a direction perpendicular to the center axis C of the shaft 30. The second partition wall 18 disconnects, i.e., closes the housing interior space 101 from the outside of the housing 11 at the one side of the housing interior space 101 where the first hysteresis mechanism 50 is accommodated.

The fourth partition wall 19 is configured into a generally triangular form and extends in a direction perpendicular to the center axis C of the shaft 30. The fourth partition wall 19 disconnects, i.e., closes the housing interior space 101 from the outside of the housing 11 at the other side of the housing interior space 101 where the second hysteresis mechanism 60 is accommodated.

Next, the operation of the accelerator apparatus 1 will be described with reference to FIGS. 6 to 7C.

When the pedal 20 is depressed by the foot of the driver of the vehicle, the pedal arm 25 is rotated about the center axis C of the shaft 30 in the accelerator opening direction in response to the pedal force applied to the pedal 20. At this time, in order to rotate the shaft 30, there is required the pedal force that generates the required torque. This required torque is a sum of a torque, which is generated by the urging forces of the first-hysteresis-portion spring, the second-hysteresis-portion spring 66 and the return spring 45, and the frictional resistance torque, which is generated by the frictional forces of the first friction plate 512 and the second friction plate 614.

The frictional resistance torque, which is generated by the frictional forces of the first friction plate 512 and the second friction plate 614, is applied to limit the rotation of the pedal 20 in the accelerator opening direction when the pedal 20 is depressed by the foot of the driver. Therefore, with reference to FIG. 6, the pedal force F (N) at the time of depressing the pedal 20 (see a solid line L1, which indicates the relationship between the pedal force F (N) and the rotational angle θ (degrees) at the time of depressing the pedal 20) is larger than the pedal force F (N) at the time of returning, i.e., releasing the pedal 20 toward the accelerator-full-closing position (see a dot-dash line L3, which indicates the relationship between the pedal force F (N) and the rotational angle θ (degrees) at the time of returning the pedal 20 toward the accelerator-full-closing position) even for the same rotational angle θ.

Next, in order to maintain the depressed state of the pedal 20, it is only required to apply the pedal force, which generates the torque that is larger than a difference between the torque, which is generated by the urging forces of the first-hysteresis-portion spring, the second-hysteresis-portion spring 66 and the return spring 45, and the frictional resistance torque, which is generated by the frictional forces of the first friction plate 512 and the second friction plate 614. In other words, when the driver wants to maintain the depressed state of the pedal 20 after depressing the pedal 20 to the desired position, the driver may reduce the applied pedal force by a certain amount.

Figure 6:
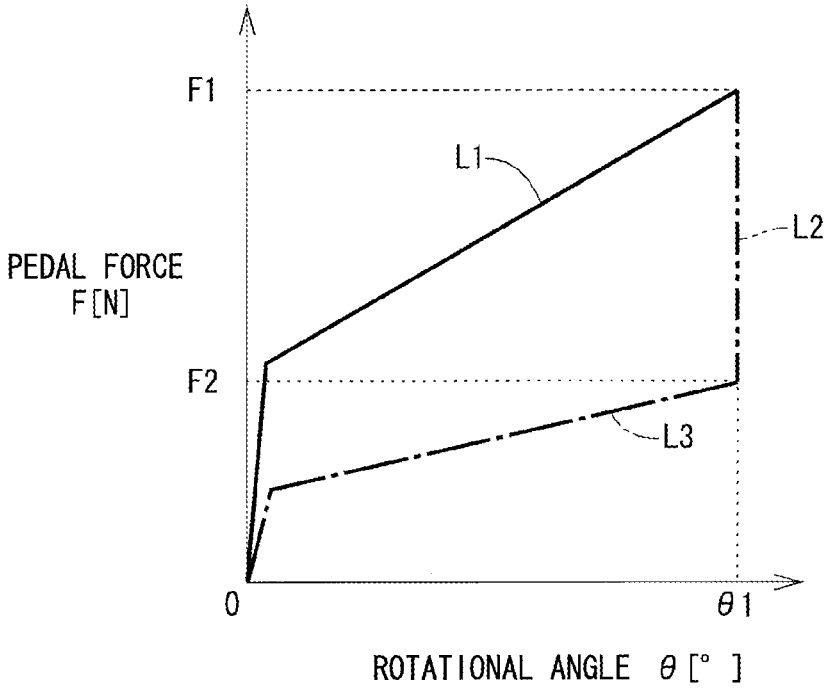
FIG. 6 is schematic diagram showing a relationship between a rotational angle of a pedal arm and a pedal force in the accelerator apparatus of the first embodiment.

As indicated by a dot-dot-dash line L2 in FIG. 6, in order to maintain the depressed state of the pedal 20 that is depressed to the rotational angle θ1, the pedal force F1 may be reduced to the pedal force F2. In this way, the depressed state of the pedal 20 can be easily maintained. The frictional resistance torque, which is generated by the frictional forces of the first friction plate 512 and the second friction plate 614, is applied to limit the rotation of the pedal 20 in the accelerator closing direction when the depressed state of the pedal 20 is maintained.

Next, in order to return the pedal 20 toward the accelerator-full-closing position of the pedal 20, there is applied the pedal force, which generates the torque that is smaller than the difference between the torque, which is generated by the urging forces of the first-hysteresis-portion spring, the second-hysteresis-portion spring 66 and the return spring 45, and the frictional resistance torque, which is generated by the frictional forces of the first friction plate 512 and the second friction plate 614. Here, when the pedal 20 needs to be quickly returned to the accelerator-full-closing position, it is only required to stop the depressing of the pedal 20. Therefore, the burden of the driver of the vehicle is minimized. In contrast, when the pedal 20 needs to be gradually returned toward the accelerator-full-closing position of the pedal 20, it is required to maintain the application of a predetermined pedal force.

As indicated by the dot-dash line L3 in FIG. 6, when the pedal 20, which has been depressed to the rotational angle θ1, needs to be gradually returned toward the accelerator-full-closing position of the pedal 20, the pedal force may be adjusted in a range from the pedal force F2 to the pedal force 0 (zero). The pedal force F2 is smaller than the pedal force F1. Therefore, when the depressed pedal 20 is returned toward the accelerator-full closing position of the pedal 20, the burden on the driver is relatively small. The frictional resistance torque, which is generated by the frictional forces of the first friction plate 512 and the second friction plate 614, is applied to limit the rotation of the pedal 20 in the accelerator closing direction when the pedal 20 is returned toward the accelerator-full closing position of the pedal 20. Therefore, the relationship between the pedal force F and the rotational angle θ at the time of returning the pedal 20 toward the accelerator-full closing position of the pedal 20 is such that the pedal force F is reduced for the same rotational angle θ as indicated by the dot-dash line L3 in FIG. 6 in comparison to the pedal force indicated by the solid line L1 at the time of depressing the pedal 20.

Furthermore, when the return spring 45 and the arm portion 52 are broken during the period of operating the accelerator apparatus 1 by the driver to cause removal of the urging force of the first-hysteresis-portion spring from the first-hysteresis-portion rotor 51, the urging force of the first-hysteresis-portion spring is applied to the first-hysteresis-portion spring receiving part 423. In this way, the pedal rotor 41 is rotated in the accelerator closing direction (the pedal closing direction). This is also true for the second-hysteresis-portion spring receiving part 424. Specifically, when the return spring 45 and the arm portion 62 are broken during the period of operating the accelerator apparatus 1 by the driver to cause removal of the urging force of the second-hysteresis-portion spring 66 from the second-hysteresis-portion rotor 61, the urging force of the second-hysteresis-portion spring 66 is applied to the second-hysteresis-portion spring receiving part 424. In this way, the pedal rotor 41 is rotated in the accelerator closing direction (the pedal closing direction).

In the accelerator apparatus 1 of the first embodiment, the frictional resistance torque, which is applied to the first-hysteresis-portion rotor 51 and the second-hysteresis-portion rotor 61, is exerted to maintain the accelerator opening degree, which corresponds to the rotational angle of the pedal arm 25 at the time of releasing the depression of the pedal 20. Thereby, it is possible to reduce or minimize the pedal force, which is required at the time of maintaining the depressed position of the pedal 20 at the desired position or at the time of gradually returning the pedal 20 toward the accelerator-full-closing position of the pedal 20. Therefore, the burden on the driver is reduced or minimized.

Figure 7A:
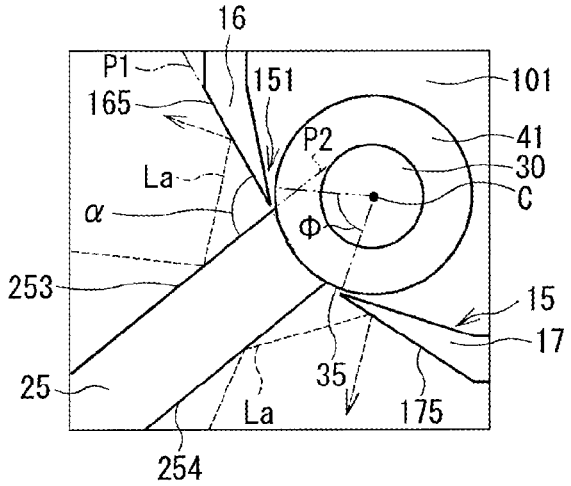
FIG. 7A is a schematic diagram showing a positional relationship between a shaft and an outer wall of a supporting member in the accelerator apparatus of the first embodiment.
Figure 7B:
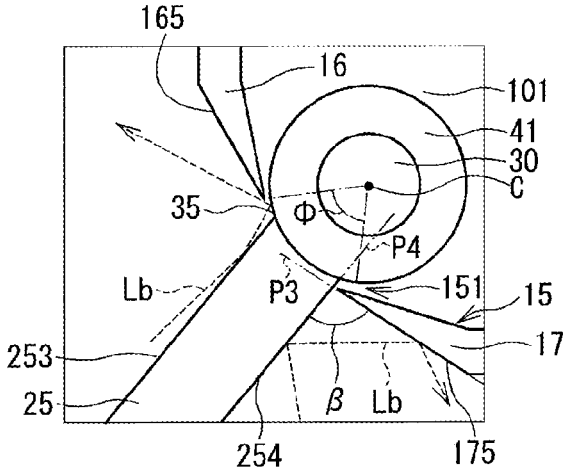
FIG. 7B is another schematic diagram showing the positional relationship between the shaft and the outer wall of the supporting member in the accelerator apparatus of the first embodiment.

Furthermore, in the accelerator apparatus 1 of the first embodiment, when a foreign object (e.g., a small pebble, particulate debris), which is present at the outside of the housing 11, is directed to approach an area adjacent to the opening 151, intrusion of the foreign object into the housing interior space 101 through the opening 151 is limited by the outer surfaces 165, 175, which form the opening 151, the upper surface 253 and the lower surface 254 of the pedal arm 25 and the exposed surface 35. The function and the advantage of the above feature will be described with reference to FIGS. 7A to 7C. FIGS. 7A to 7C illustrate a positional relationship between the first partition wall, which defines the opening, and the upper surface of the pedal arm as well as a positional relationship between the third partition wall and the lower surface of the pedal arm for the case of the first embodiment (FIGS. 7A and 7B) and a case of a comparative example (FIG. 7C).

More specifically, FIG. 7A shows the relationship between the pedal arm 25 and the opening segment 15 at the accelerator-full-closing time of the accelerator apparatus 1. At this time, as indicated by a dotted line La in FIG. 7A, the foreign object, which is present at the outside of the housing 11 and is directed to approach the area adjacent to the opening 151, cannot approach the opening 151. This is because of that the angle α, which is formed between the imaginary extension plane P1 of the outer surface 165 and the imaginary extension plane P2 of the upper surface 253, is set to be the obtuse angle. In the case where the angle α is set to be the obtuse angle, the foreign object, which is present at the outside of the housing 11 and is directed to approach the area adjacent to the opening 151, is bounced over the outer surface 165, the upper surface 253 and/or the exposed surface 35 of the shaft 30 toward the outside of the housing 11. Thereby, the foreign object cannot approach the opening 151.

FIG. 7B shows the relationship between the pedal arm 25 and the opening segment 15 at the accelerator-full-opening time of the accelerator apparatus 1. At this time, as indicated by a dotted line Lb in FIG. 7B, the foreign object, which is present at the outside of the housing 11 and is directed to approach the area adjacent to the opening 151, cannot approach the opening 151. This is because of that the angle β, which is formed between the imaginary extension plane P3 of the outer surface 175 and the imaginary extension plane P4 of the lower surface 254, is set to be the obtuse angle. In the case where the angle β is set to be the obtuse angle, the foreign object, which is present at the outside of the housing 11 and is directed to approach the area adjacent to the opening 151, is bounced over the outer surface 175, the upper surface 254 and/or the exposed surface 35 of the shaft 30 toward the outside. Thereby, the foreign object cannot approach the opening 151.

Figure 7C:
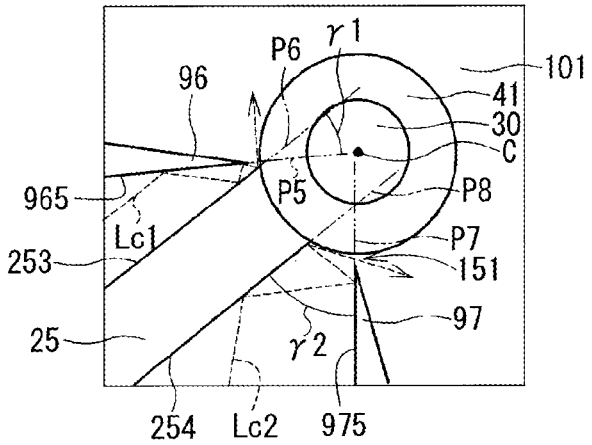
FIG. 7C RELATED ART
FIG. 7C is a schematic diagram showing a relationship between a shaft and an outer wall of a supporting member in an accelerator apparatus of a comparative example.

FIG. 7C shows the comparative example for illustrating the advantage of the accelerator apparatus 1 of the first embodiment. In FIG. 7C, an angle γ1 is formed between an imaginary extension plane P5 of an outer surface 965 of a first partition wall 96 and an imaginary extension plane P6 of the upper surface 253 of the pedal arm 25 and is set to be an acute angle. Furthermore, an angle γ2 is formed between an imaginary extension plane P7 of an outer surface 975 of a third partition wall 97 and an imaginary extension plane P8 of the lower surface 254 of the pedal arm 25 and is set to be an acute angle. As indicated by dotted lines Lc1, Lc2 in FIG. 7C, the foreign object, which is present at the outside of the housing 11 and is directed to approach the area adjacent to the opening 151, collides several times with corresponding ones of the outer surfaces 965, 975, the upper surface 253, the lower surface 254 and the exposed surface 35 and finally enters the housing interior space 101 through the opening 151.

Therefore, in the accelerator apparatus 1 of the first embodiment, it is possible to reduce the amount of foreign objects, which enter the housing interior space 101 through the opening 151, in comparison to, for example, the comparative example discussed above.

(Second Embodiment)

Figure 8:
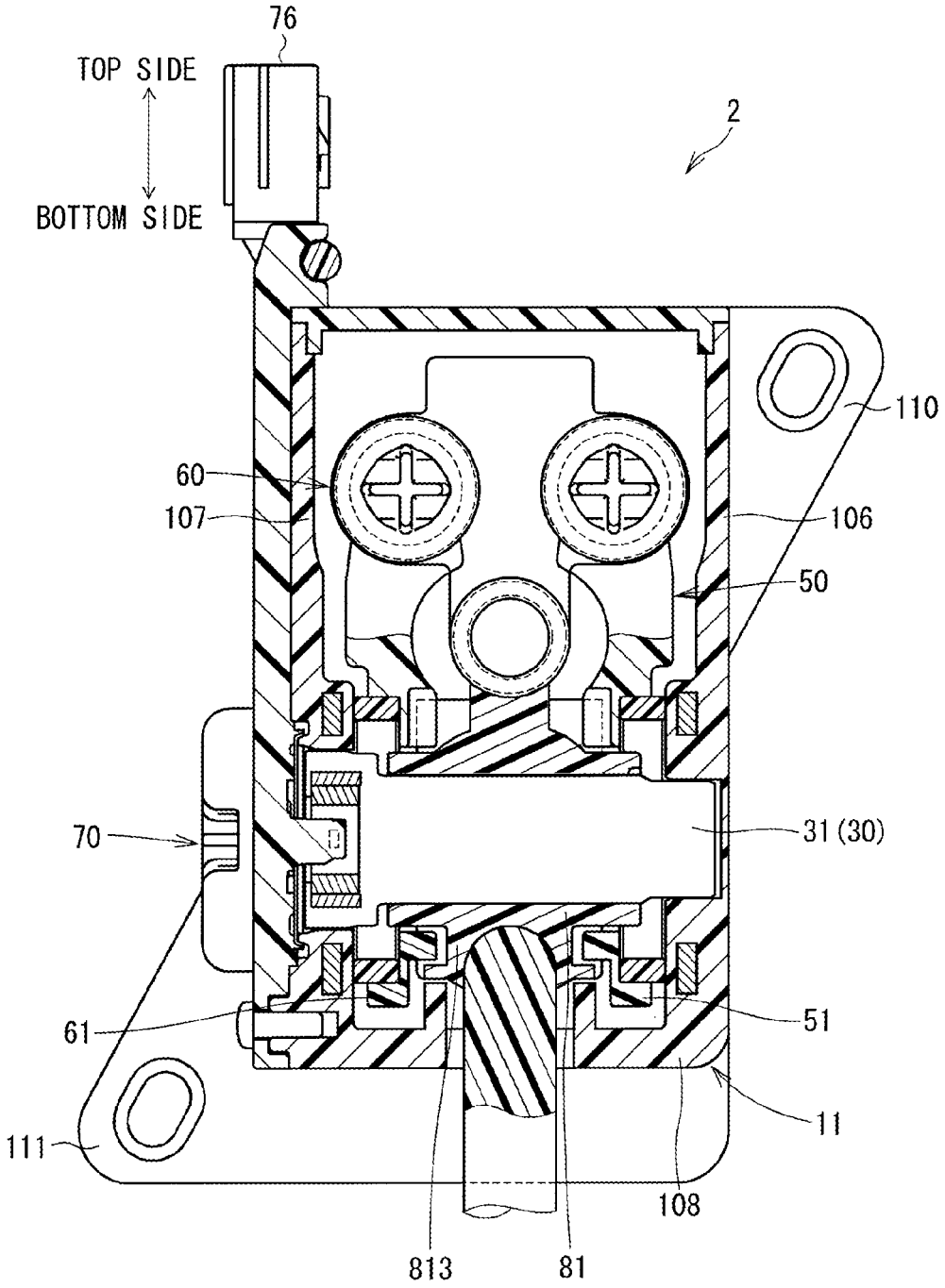
FIG. 8 is a front cross-sectional view of an accelerator apparatus according to a second embodiment of the present disclosure.

Next, an accelerator apparatus according to a second embodiment of the present disclosure will be described with reference to FIG. 8. In the second embodiment, the shape of the pedal rotor is different from the shape of the pedal rotor of the first embodiment. In the following description, components, which are similar to those of the first embodiment, will be indicated by the same reference numerals and will not be described further.

In the accelerator apparatus 2 of the second embodiment, a portion of the peal rotor 81 is configured into a spherical form. Specifically, in the second embodiment, a connecting portion 813 of the pedal rotor 81, which corresponds to the connecting portion 413 of the pedal rotor 41 of the first embodiment, is connected to the pedal arm 25. The connecting portion 813 of the second embodiment is configured into the spherical form and projects to the outside of the housing 11 from the opening 151. In other words, the shape of the connecting portion 813 of the pedal rotor 81, which is located adjacent to the opening 151, is the spherical shape that spherically extends about a point located along the center axis C of the shaft 30. Therefore, in the accelerator apparatus 2 of the second embodiment, because of the connecting portion 813, which is configured into the spherical form and projects from the opening 151, it is possible to bounce the foreign object, which is present at the outside of the housing 11 and is directed to approach the area adjacent to the opening 151, toward the outside of the housing 11. Thereby, the advantage, which is similar to the advantage of the accelerator apparatus 1 of the first embodiment, can be achieved with the accelerator apparatus 2 of the second embodiment.

Now, modifications of the first and second embodiments will be described.

(I) In the first embodiment, the pedal rotor 41 is configured into the cylindrical form. In the second embodiment, the pedal rotor 81 is configured to have the spherical form in the portion (the connecting portion 813) of the pedal rotor 81. However, the configuration of the pedal rotor of the present disclosure is not limited to these forms. Specifically, the pedal rotor of the present disclosure may have any other suitable configuration as long as the exposed surface of the pedal rotor, which is exposed to the outside from the opening 151, is configured to have the arcuate section.

(II) In the above embodiments, the angle, which is formed between the outer surface of the first partition wall and the upper surface of the pedal arm at the accelerator-full-closing time, is set to be the obtuse angle. Furthermore, the angle, which is formed between the outer surface of the third partition wall and the lower surface of the pedal arm at the accelerator-full-opening time, is set to be the obtuse angle. However, the angle, which is formed between the outer surface of the first partition wall and the upper surface of the pedal arm at the accelerator-full-closing time, and the angle, which is formed between the outer surface of the third partition wall and the lower surface of the pedal arm at the accelerator-full-opening time, are not limited to the obtuse angles. For instance, the angle, which is formed between the outer surface of the first partition wall and the upper surface of the pedal arm at the accelerator-full-closing time, and the angle, which is formed between the outer surface of the third partition wall and the lower surface of the pedal arm at the accelerator-full-opening time, may be 90 degrees (a right angle). Furthermore, in the case where the angle, which is formed between the outer surface of the first partition wall and the upper surface of the pedal arm at the accelerator-full-closing time, and the angle, which is formed between the outer surface of the third partition wall and the lower surface of the pedal arm at the accelerator-full-opening time, are equal to or larger than 90 degrees (one of the right angle and the obtuse angle), the foreign object, which is present at the outside of the housing and is directed to approach the area adjacent to the opening of the housing, is bounced over the outer surface of the first partition wall and the upper surface of the pedal arm or is bounced over the outer surface of the third partition wall and the lower surface of the pedal arm toward the outside of the housing. Therefore, it is possible to limit or reduce the amount of foreign objects, which enter the housing interior space through the opening of the housing.

In the first and second embodiments, the rotational angle sensing device has the Hall element. However, the rotational angle sensing device of the present disclosure is not limited to such a rotational angle sensing device. For instance, in place of the rotational angle sensing device, which has the Hall element, another type of a well known rotational angle sensing device, which has, for example, a magnetoresistive sensing element may be used. Furthermore, in the first and second embodiments, the return spring 45, which is made of a coil spring, is used as the urging device (or the urging means). However, the urging device of the present disclosure is not limited to such a spring. For instance, the urging device may be formed of, for example, a leaf spring, a resilient rubber, a resilient synthetic resin or the like as long as the urging device can urge the shaft 30 and the pedal rotor 41 in the accelerator closing direction.

The present disclosure is not limited to the above embodiments, and the above embodiments may be modified within the spirit and scope of the present disclosure.

What is claimed is:

1. An accelerator apparatus for a vehicle, comprising:

a supporting member that is installable to a body of the vehicle;

a rotatable body that is received in an interior of the supporting member and is rotatable about a rotational axis of the rotatable body relative to the supporting member; and a pedal arm that has one end portion, which is fixed to a connecting portion of the rotatable body, wherein the other end portion of the pedal arm, which is opposite from the one end portion of the pedal arm and projects outward from an opening of the supporting member, has a depressible portion that is depressible by a driver of the vehicle, wherein:

the rotatable body includes:

first and second primary projections, which project in an axial direction of the rotational axis of the rotatable body, are located on one axial side and another axial side, respectively, of the rotatable body to extend symmetrically with respect to the one end portion of the pedal arm; and first and second secondary projections, which project in the axial direction of the rotational axis and are located on the one axial side and the another axial side, respectively, of the rotatable body;

the first and second primary projections are located on a radially outer side of the rotational axis and extend in a circumferential direction all around the rotational axis of the rotatable body;

the first and second secondary projections project from the connecting portion of the rotatable body in the axial direction of the rotational axis and are located on a radially outer side of the first and second primary projections in a radial direction of the rotational axis of the rotatable body;

an axial extent of each of the first and second primary projections, which is measured in the axial direction of the rotational axis, is larger than an axial extent of each of the first and second secondary projections, which is measured in the axial direction of the rotational axis;

the supporting member includes two partition walls that are located on one axial side and another axial side, respectively, of the opening of the supporting member in the axial direction of the rotational axis to define the one axial side and the another axial side, respectively, of the opening of the supporting member;

the first and second secondary projections are placed adjacent to the two partition walls, respectively, and are opposed to the two partition walls, respectively, in the radial direction of the rotational axis of the rotatable body; and the axial extents of the first and second secondary projections, which are measured in the axial direction of the rotational axis, respectively axially overlap with axial extents of the two partition walls, which are measured in the axial direction of the rotational axis.

2. The accelerator apparatus according to claim 1, wherein:

an outer wall of the rotatable body, which is located adjacent to the opening, forms a protruding curved surface, which protrudes in a projecting direction of the pedal arm from the rotatable body, in a movable range of the pedal arm;

an angle between a first imaginary extension plane of a first outer surface of a first outer wall, which is formed in an outer wall of the supporting member, and a second imaginary extension plane of a second outer wall, which is formed in the pedal arm, is an obtuse angle;

the first outer wall defines the opening and is located on an accelerator closing side of the opening in the accelerator closing direction;

the second outer wall is located on an accelerator closing side of the pedal arm in the accelerator closing direction;

an angle between a third imaginary extension plane of a third outer surface of a third outer wall, which is formed in the outer wall of the supporting member, and a fourth imaginary extension plane of a fourth outer wall, which is formed in the pedal arm, is an obtuse angle;

the third outer wall defines the opening and is located on an accelerator opening side of the opening in the accelerator opening direction;

the fourth outer wall is located on an accelerator opening side of the pedal arm in the accelerator opening direction;

the connecting portion is placed adjacent to the first outer surface of the first outer wall when the pedal arm is placed in an accelerator-full-closing position; and the connecting portion is placed adjacent to the third outer surface of the third outer wall when the pedal arm is placed in an accelerator-full-opening position.

3. An accelerator apparatus for a vehicle, comprising:

a supporting member that is installable to a body of the vehicle;

a rotatable body that is received in an interior of the supporting member and is rotatable about a rotational axis of the rotatable body relative to the supporting member; and a pedal arm that has one end portion, which is fixed to a connecting portion of the rotatable body, wherein the other end portion of the pedal arm, which is opposite from the one end portion of the pedal arm and projects outward from an opening of the supporting member, has a depressible portion that is depressible by a driver of the vehicle, wherein:

the rotatable body includes first and second projections, which project in the axial direction of the rotational axis and are located on one axial side and another axial side, respectively, of the rotatable body;

the supporting member includes two partition walls that are located on one axial side and another axial side, respectively, of the opening of the supporting member in the axial direction of the rotational axis to define the one axial side and the another axial side, respectively, of the opening of the supporting member and the two partition walls extend symmetrically with respect to the one end portion of the pedal arm;

the first and second projections are placed adjacent to the two partition walls, respectively, and are opposed to the two partition walls, respectively, in a radial direction of the rotational axis of the rotatable body; and axial extents of the first and second projections, which are measured in the axial direction of the rotational axis, respectively axially overlap with axial extents of the two partition walls, which are measured in the axial direction of the rotational axis.

4. The accelerator apparatus according to claim 3, wherein:

an outer wall of the rotatable body, which is located adjacent to the opening, forms a protruding curved surface, which protrudes in a projecting direction of the pedal arm from the rotatable body, in a movable range of the pedal arm;

an angle between a first imaginary extension plane of a first outer surface of a first outer wall, which is formed in an outer wall of the supporting member, and a second imaginary extension plane of a second outer wall, which is formed in the pedal arm, is an obtuse angle;

the first outer wall defines the opening and is located on an accelerator closing side of the opening in the accelerator closing direction;

the second outer wall is located on an accelerator closing side of the pedal arm in the accelerator closing direction;

an angle between a third imaginary extension plane of a third outer surface of a third outer wall, which is formed in the outer wall of the supporting member, and a fourth imaginary extension plane of a fourth outer wall, which is formed in the pedal arm, is an obtuse angle;

the third outer wall defines the opening and is located on an accelerator opening side of the opening in the accelerator opening direction;

the fourth outer wall is located on an accelerator opening side of the pedal arm in the accelerator opening direction;

the connecting portion is placed adjacent to the first outer surface of the first outer wall when the pedal arm is placed in an accelerator-full-closing position; and the connecting portion is placed adjacent to the third outer surface of the third outer wall when the pedal arm is placed in an accelerator-full-opening position.

* * * * *